US011634921B1

(12) United States Patent
Deng

(10) Patent No.: US 11,634,921 B1
(45) Date of Patent: Apr. 25, 2023

(54) SWIMMING POOL WATER VALVE WITH A SUPPORT ELEMENT

(71) Applicant: Huifeng Huang, Shenzhen (CN)

(72) Inventor: Wenjie Deng, Shenzhen (CN)

(73) Assignee: Wenjie Deng, Shenzhen (CN)

( * ) Notice: Subject to any disclaimer, the term of this patent is extended or adjusted under 35 U.S.C. 154(b) by 0 days.

(21) Appl. No.: 17/883,781

(22) Filed: Aug. 9, 2022

(30) Foreign Application Priority Data

Jul. 5, 2022 (CN) ..... 202221735657.9

(51) Int. Cl.
*E04H 4/14* (2006.01)

(52) U.S. Cl.
CPC ..... *E04H 4/14* (2013.01)

(58) Field of Classification Search
CPC ..... E04H 4/14
USPC ..... 4/506–509, 513, 494; 482/55
See application file for complete search history.

(56) References Cited

U.S. PATENT DOCUMENTS 3,781,925 A * 1/1974 Curtis ..... F24D 17/00 4/493
3,988,787 A * 11/1976 Colee ..... F16K 11/065 137/625.13
4,371,003 A * 2/1983 Goguen ..... F16K 11/072 137/625.46
4,389,739 A * 6/1983 Baker ..... E04H 4/1227 4/510
4,421,643 A * 12/1983 Frederick ..... E04H 4/1245 210/138
4,607,399 A * 8/1986 Yovanofski ..... E04H 4/12 137/429
4,817,217 A * 4/1989 Lively ..... E04H 4/12 210/138
5,787,519 A * 8/1998 Smith ..... E04H 4/0043 4/488
5,809,587 A * 9/1998 Fleischer ..... A61H 33/6073 4/287
5,822,807 A * 10/1998 Gallagher ..... E04H 4/12 137/526
7,784,117 B2 * 8/2010 Hamza ..... F04D 15/0218 417/306
7,811,448 B2 * 10/2010 Johnson ..... B01F 35/213 210/138
2013/0145539 A1 * 6/2013 Cooke ..... E04H 4/1272 4/494
2014/0123381 A1 * 5/2014 Stephens ..... F04B 17/006 137/565.33

(Continued)

*Primary Examiner* — Lori L Baker

(57) ABSTRACT

A swimming pool water valve with a support element, comprising a water valve main body and a support element, wherein the support element and the water valve main body are integrally formed or assembled on the water valve main body, the support element supports the water valve main body, the water valve main body comprises a water inlet, a water outlet and a switch valve, wherein the water inlet is connected with the swimming pool, and the switch valve controls the connection and the separation of the water inlet and the water outlet. The swimming pool water valve is supported by the support element, so as to realize the function of protecting the drainage outlet and the water intake of the swimming pool from being torn and damaged easily and avoiding water leakage, thereby achieving the effect of long-term stable and safe use of the product.

10 Claims, 4 Drawing Sheets

(56) References Cited

U.S. PATENT DOCUMENTS

| | | | | |
|---|---|---|---|---|
| 2015/0315803 | A1* | 11/2015 | Hamza | E04H 4/14<br>4/509 |
| 2018/0141197 | A1* | 5/2018 | Pugliese | E04H 4/14 |
| 2022/0056718 | A1* | 2/2022 | Murray | E04H 4/12 |

* cited by examiner

SWIMMING POOL WATER VALVE WITH A SUPPORT ELEMENT

CROSS REFERENCE TO RELATED APPLICATION

This application claims priority benefit of Chinese invent Application No. 202221735657.9, filed on Jul. 5, 2022, and the entire contents of which are incorporated herein by reference.

TECHNICAL FIELD OF THE INVENTION

The present invention involves the technical field of switch water valves, specifically relates to a swimming pool water valve with a support element.

BACKGROUND OF THE INVENTION

At present, the drainage outlet and the water intake of the plastic swimming pool are generally arranged on the side wall of the swimming pool. A switch valve is needed to be connected with the drainage outlet and the water intake of the swimming pool, and then the switch valve is connected with a filter to realize the functions of water circulation and the filtering of the swimming pool. However, in actual use, due to the gravity of the switch valve and the water pipe itself, the switch valve will tilt downward, and the water inlet of the switch valve can no longer fit with the drainage outlet and water intake of the swimming pool, which on the one hand will cause the pool water to overflow from the connection and the switch valve will fail, and on the other hand will cause the drainage outlet and water intake of the swimming pool to also fall downward, tearing the structure at the drainage outlet and water intake of the swimming pool, thereby damaging the swimming pool and making it unusable.

SUMMARY OF THE INVENTION

The present invention provides a swimming pool water valve with a support element. The swimming pool water valve is supported by the support element so as to realize the function of protecting the drainage outlet and the Water intake of the swimming pool from being torn and damaged easily and avoiding water leakage, thereby achieving the effect of long-term stable and safe use of the product.

In order to realize the purpose of the present invention, the present invention provides the following technical solutions:

A swimming pool water valve with a support element, comprising a water valve main body and a support element, wherein the support element and the water valve main body are integrally formed or assembled on the water valve main body, the support element supports the water valve main body, the water valve main body comprises a water inlet, a water outlet and a switch valve, wherein the water inlet is connected with the swimming pool, and the switch valve controls the connection and the separation of the water inlet and the water outlet.

Preferably, the support element comprises a support framework and a support head, wherein the support framework is connected with the water valve main body and the support head, which rests against the side wall of the swimming pool, i.e. the support framework connects the water valve main body to the support head. The support framework can transmit the gravity of water valve main body to the support head, the support head is forced and pushes against the side wall of the swimming pool, and the side wall of the swimming pool generates a reaction force correspondingly to balance the thrust of the support head. The reaction force is transmitted to the water valve main body through the supporting framework. The gravity of the water valve main body is balanced with the reaction force, the water valve main body is not influenced by the gravity any more. The support framework and the support head realize the function of transmitting the gravity of the water valve main body to the side wall of the swimming pool.

Preferably, at the water inlet is further provided with a spring clamp, wherein the spring clamp fixes the water inlet on a drainage outlet or a water intake of the swimming pool, thereby ensuring the firm installation of the water inlet and the drainage outlet or the water intake of the swimming pool.

Preferably, the switch valve comprises a knob, a threaded rod and a water stop plug, wherein the knob rotates on the threaded rod, and the knob drives the water stop plug to close or open the water outlet. The opening and closing of the water flow and the water flow rate can be adjusted by means of the knob.

Preferably, the switch valve further comprises a knob cover, wherein the knob cover fixes the knob on the water valve main body, so that it can ensure the firm installation of the knob, and the knob is not easy to fall off from the water valve main body.

Preferably, the water stop plug and the knob are both provided with an O-shaped sealing ring. The O-shaped sealing rings can enhance the tightness, and avoid the water flow from overflowing from the water stop plug and the knob to influence the use experience.

Preferably, a silica gel pad is arranged on the contact surface, of the knob cover and the water valve main body. The silica gel pad is soft and elastic, and can prevent the knob cover from rigidly contacting the water valve main body 1, thereby having the anti-knock and slide-proof effects.

Preferably, the water outlet is provided with a plurality of pipe orifices with different calibres, wherein the pipe orifices are used for connecting water pipes with different diameters, which can enhance the applicability of the water valve main body. The pipe orifices with corresponding calibres can be used for connecting different water pipes, the water, pipes or water valves do not need to be purchased again, and the use cost is saved.

The advantageous effects of the present invention lie in that:

The present invention is provided with a water valve main body and a support element. The support element and the water valve main body can be integrally formed, the support element also can be assembled on the water valve main body, the support element can support the water valve main body, embodied as: the side wall of the swimming pool is provided with a drainage outlet or a water intake, the water inlet of the water valve main body is aligned with the drainage outlet or the water intake of the side wall of the swimming pool, and the water inlet is connected with the drainage outlet or the water intake. The support element naturally rests against the side wall of the swimming pool. The water valve main body and the water pipe generate a downward gravity due to gravity, and the downward gravity is transmitted to the support element, so that the support element generates a thrust against the side wall of the swimming pool. According to Newton's third law, the side wall of the swimming pool will generate a reaction force of the same magnitude and opposite direction as the thrust, which cancels out the thrust. The support element and the side wall of the swimming pool support the water valve main body. The water valve main body and the water pipe cannot droop under the action of gravity. The water inlet can be attached to the drainage outlet and the water intake of the swimming pool, so that overflow cannot occur, the drainage outlet and the water intake of the side wall of the swimming pool is prevented from being tom and damaged, and the swimming pool, is, good in durability and using effect.

Moreover, the water valve main body comprises a water inlet, a water outlet and a switch valve, and the side wall of the swimming pool is provided with a drainage outlet or a water intake. Therefore, the present invention can be assembled on the drainage outlet, at tins time, the water flow direction flows from the drainage outlet through the water inlet, passes through the switch valve, and is discharged, from the water outlet; and can be assembled on the water intake, at this time, the water flow direction flows from the water outlet, passes through the switch valve and flows from the water intake through the water inlet into the swimming pool. The inflow and outflow of the pool water can be realized through the same water valve, and the water inlet valve and the drainage valve do not need to be purchased additionally. The switch valve controls the connection and the separation of the water inlet and the water outlet, thereby controlling the opening and the closing of the inflow water flow and the outflow water flow of the pool water.

Therefore, the present invention provides a swimming pool water valve with a support element, which can realize the function of protecting the drainage outlet and the water intake of the swimming pool from being torn and damaged easily and avoiding water leakage, thereby achieving the effect of long-term stable and safe use of the product.

DETAILED DESCRIPTION OF THE PREFERRED EMBODIMENT

Figure 1:
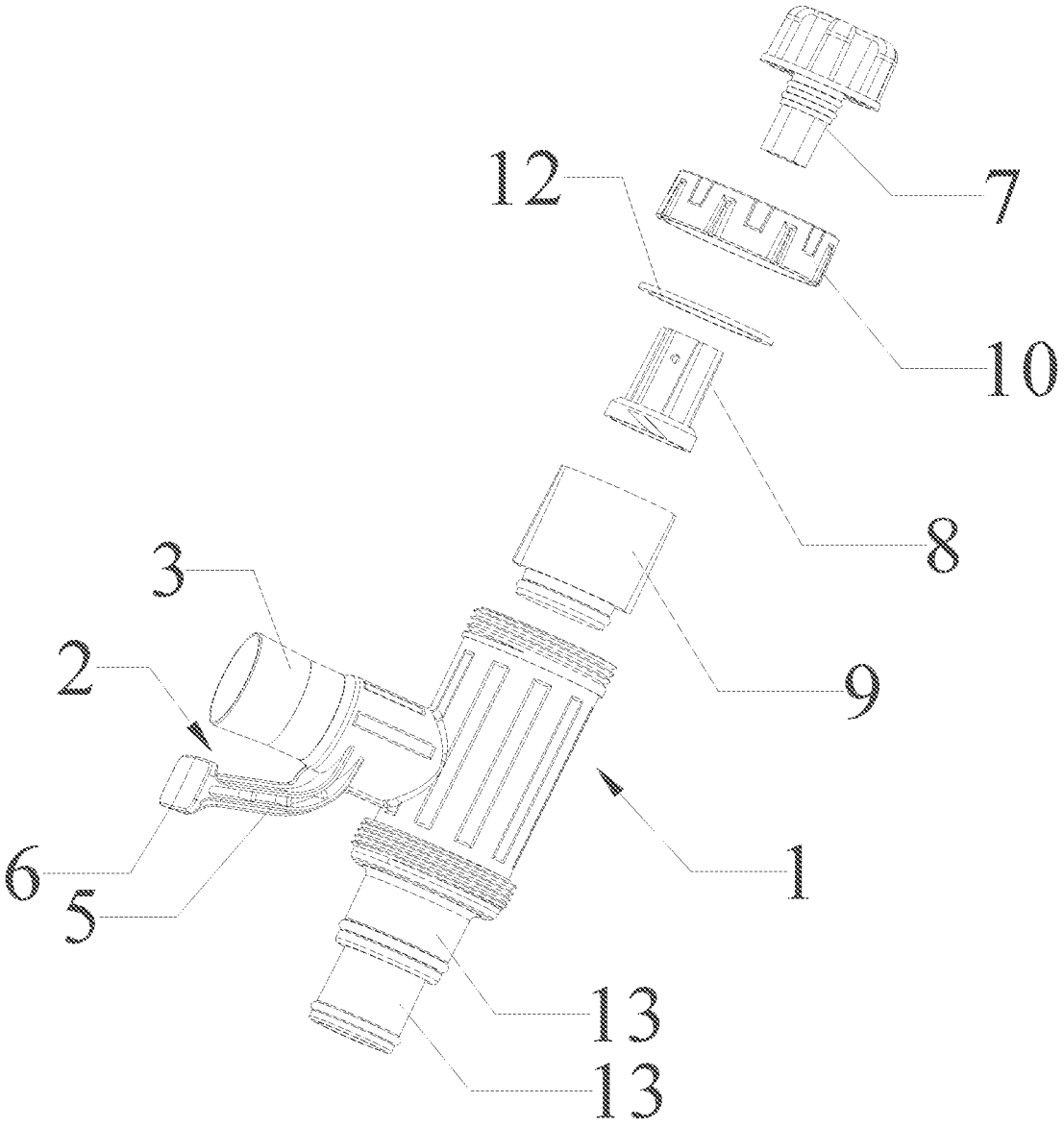
FIG. 1 is a schematic view of the divided structure of the present invention.

The technical solutions of the embodiments of the present invention will be clearly and entirely described below with the drawings of the embodiments of the present invention. Obviously, the described embodiments are just a part of the embodiments of the present invention, and are not all of them. All other embodiments that can be obtained by a person skilled in the art based on the embodiments of the present invention without any creative effort are, included in the protection scope of the present invention.

It should be noted that, all the directional indications (such as up, down, left right, front, rear in the embodiments of the present invention are merely used for explaining the relative positional relationship and movement conditions and the like between each part under a certain posture (as shown in the drawings), if such a posture changes, then the directional indications are changed correspondingly.

In the present invention, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present invention, "a plurality of" means at least two, for example, two, three and the like, unless otherwise specifically defined.

In the present invention, unless otherwise definitely prescribed and defined, the terms "connection", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium, and can also be the internal communication inside two elements or an interaction relationship between two elements, unless otherwise definitely defined. The specific meaning of the above-mentioned terms in the present invention may be understood by those of ordinary skill in the art in light of specific circumstances.

In addition, the technical solutions between each embodiment in the present invention can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present invention.

Figure 2:
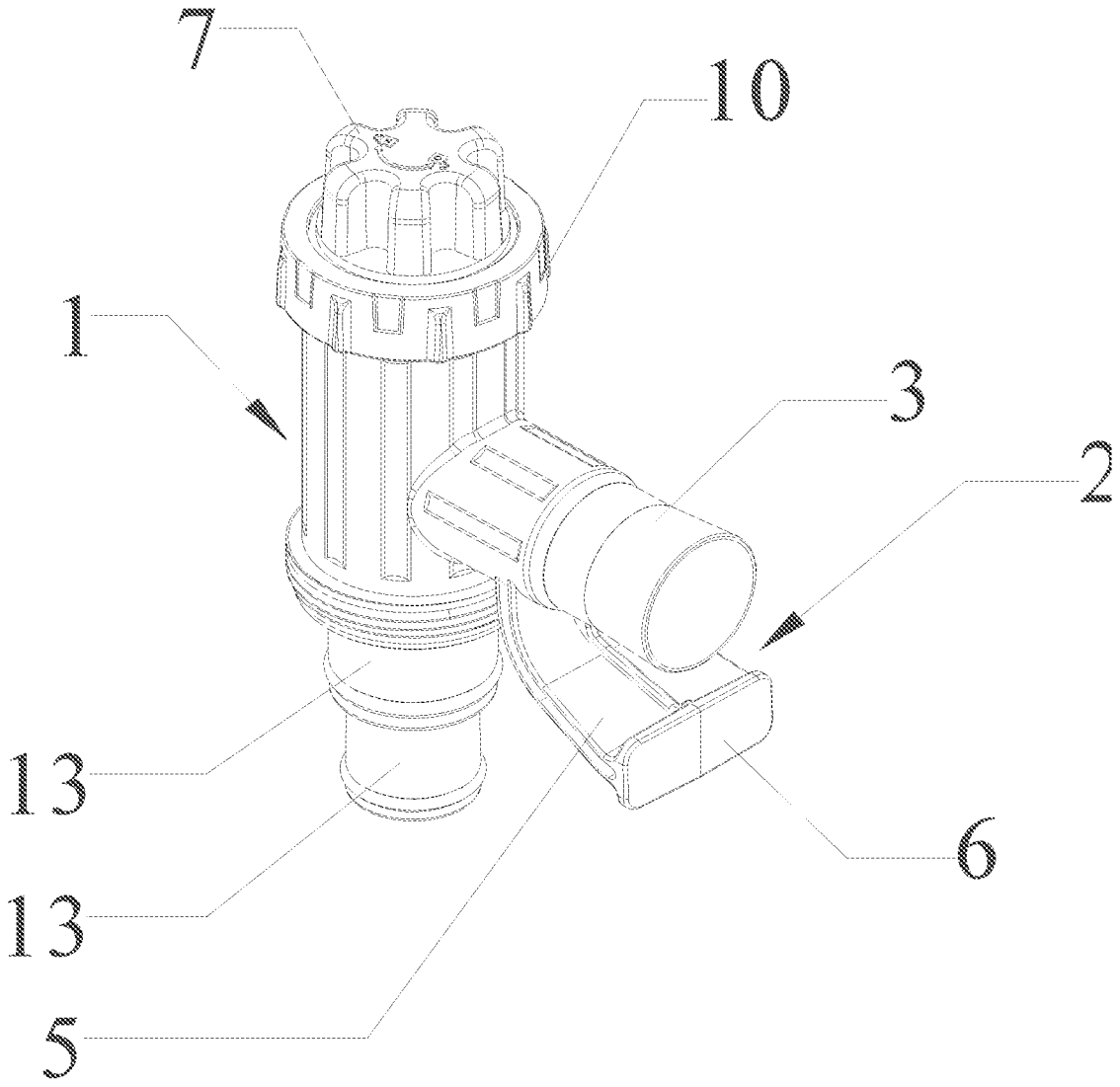
FIG. 2 is a schematic view of the overall structure of the present invention.
Figure 3:
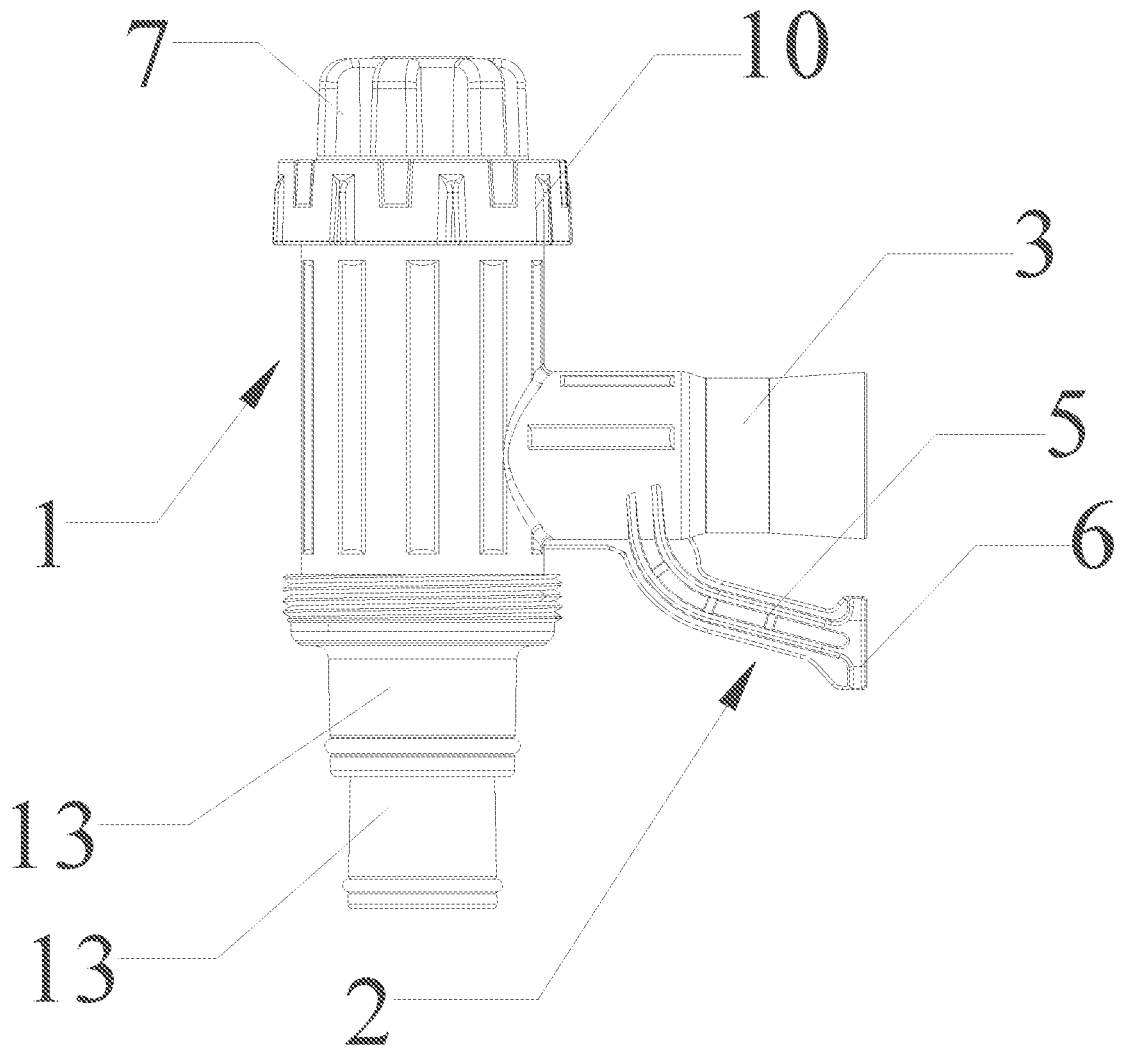
FIG. 3 is a schematic side view of the structure of the first embodiment of the present invention.
Figure 4:
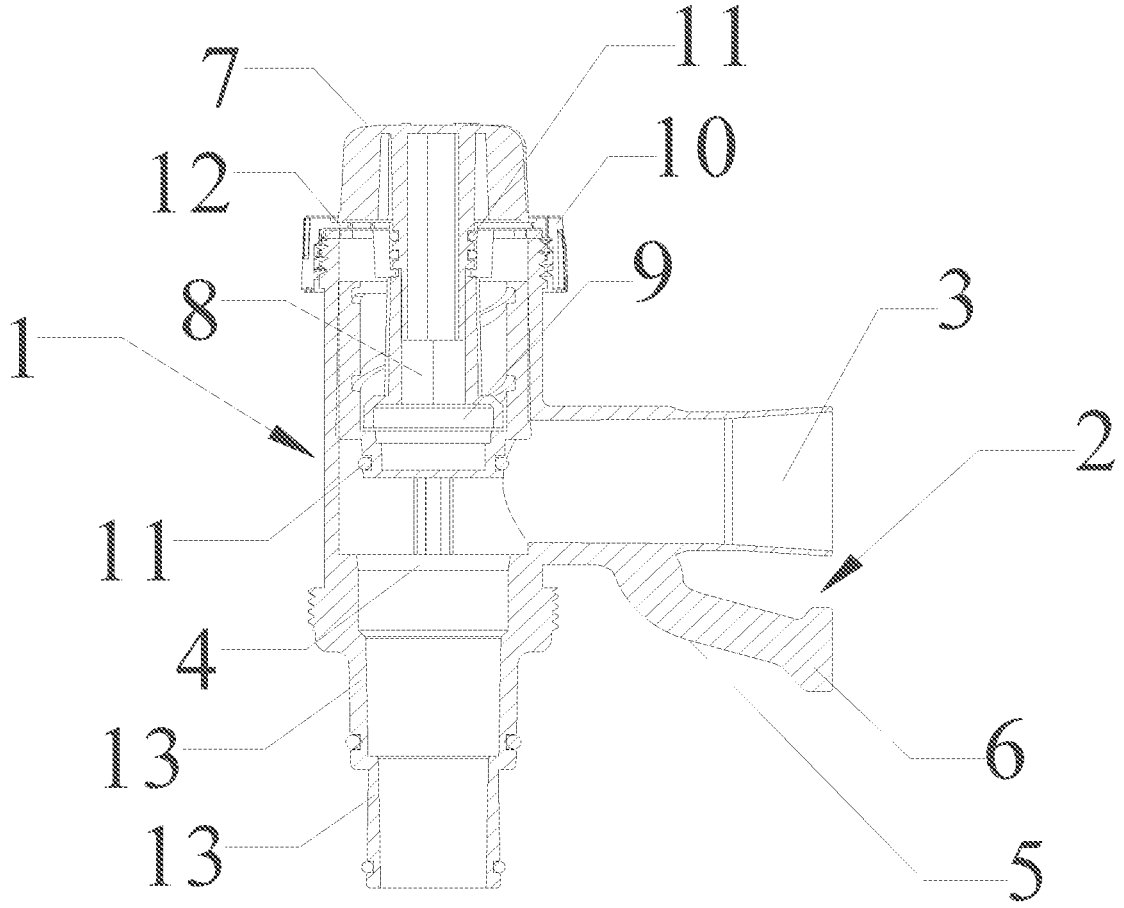
FIG. 4 is a perspective schematic view of the structure of the first embodiment of the present invention.

Referring to FIGS. 1-4, FIG. 1 is a schematic view of the divided structure of the present invention; FIG. 2 is a schematic view of the overall structure of the present invention; FIG. 3 is a schematic side view of the structure of the first embodiment of the present invention; and FIG. 4 is a perspective schematic view of the structure of the first embodiment of the present invention.

The present invention provides a swimming pool water valve with a support element. The names of the components corresponding to the reference numerals, in the figures are as follows: water valve main body 1, support element 2, water inlet 3, water outlet 4, support framework 5, support head 6, knob 7, threaded rod 8, water stop plug 9, knob cover 10, silica gel pad 12, pipe orifice 13.

A swimming pool water valve with a support element 2, comprising a water valve main body 1 and a support element 2, wherein the support element 2 and the water valve main body 1 are integrally formed or assembled on the water valve main body 1, the support element 2 supports the water valve main body 1, the water valve main body 1 comprises a water inlet 3, a water outlet 4 and a switch valve, wherein the water inlet 3 is connected with the swimming pool, and the switch valve controls the connection and the separation of the water inlet 3 and the water outlet 4.

Preferably, the support element 2 comprises a support framework 5 and a support head 6, wherein the support framework 5 is connected with the water valve main body 1 and the support head 6, which rests against the side wall of the swimming pool. The support framework 5 can transmit the gravity of water valve main body 1 to the support head 6, the support head 6 is forced and, pushes against the side wall of the swimming pool, and the side wall of the swimming pool generates a reaction force correspondingly to balance the thrust of the support head 6. The reaction force is transmitted to the water valve main body 1 through the supporting framework 5. The gravity of the water valve main body 1 is balanced with the reaction force, the water valve main body 1 is not influenced by the gravity any more. The support framework 5 and the support head 6 realize the function of transmitting the gravity of the water valve main body 1 to the side wall of the swimming pool.

At the water inlet 3 is further provided with a spring clamp, wherein the spring clamp fixes the water inlet 3 on a drainage outlet or a water intake of the swimming pool, thereby ensuring the firm installation of the water inlet 3 and the drainage outlet or the water intake of the swimming pool.

The switch valve comprises a knob 7, a threaded rod 8 and a water stop plug 9, wherein the knob 7 rotates on the threaded rod, and the knob 7 drives the water stop plug 9 to close or open the water outlet 4. The opening and closing of the water flow and the water flow rate can be adjusted by means of the knob 7.

The switch valve further comprises a knob cover 10, wherein the knob cover 10 fixes the knob 7 on the water valve main body 1, so that it can ensure the firm installation of the knob 7, and the knob 7 is not easy to fall off from the water valve main body 1.

The water stop plug 9 and the knob 7 are both provided with an O-shaped sealing ring 11. The O-shaped sealing rings 11 can enhance the tightness, and avoid the water flow from overflowing from the water stop plug 9 and the knob 7 to influence the use experience.

A silica gel pad 12 is arranged on the contact surface of the knob cover 10 and the water valve main body 1. The silica gel pad 12 is soft and elastic, and can prevent the knob cover 10 from rigidly contacting the water valve main body 1, thereby having the anti-knock and slide-proof effects.

The water outlet 4 is provided with a plurality of pipe orifices 13 with different calibres, wherein the pipe orifices 13 are used for connecting water pipes with different diameters, which can enhance the applicability of the water valve main body 1. The pipe orifices 13 with corresponding calibres can be used for connecting different water pipes, the water pipes or water valves do not need to be purchased again, and the use cost is saved.

In the first embodiment, the support element 2 and the water valve main body 1 are integrally formed, one end of the support framework 5 is arranged on the water inlet pipe on the water valve main body 1, the other end of the support framework 5 is connected with the support head 6, and the water outlet 4 is provided with a 1.5-inch pipe orifice 13 and a 1.25-inch pipe orifice 13. The knob 7 penetrates through the threaded rod 8 and is fixed with the water stop plug 9 to form the switch valve for use, the knob 7 is fixed through the knob cover 10, the water stop plug 9 is aligned with the water outlet 4, the knob 7 is rotated, the knob 7 drives the water stop plug 9 to ascend or descend, the water stop plug 9 plugs or opens the water outlet 4 so as to open and close the switch valve.

The use and working method, of the first embodiment lies in that: the water inlet 3 is sleeved on the drainage outlet of the swimming pool, the water inlet 3 and the drainage outlet of the swimming pool are fixed together through the spring clamp, the support head 6 is abutted against the side wall of the swimming pool, and the water outlet 4 is connected with the water pipe with the pipe diameter of 1.5 inches. When water needs to be drained, the knob 7 is rotated counterclockwise, the knob 7 drives the water stop plug 9 to rise, the water stop plug 9 does not block the water outlet 4 anymore, and at the moment, the water flow direction flows through the water inlet 3 from the drainage outlet, passes through the switch valve and flows into the water pipe from the water outlet 4 to be drained. When the water is not required to be drained, the knob 7 is rotated clockwise, the knob 7 drives the water stop plug 9 to descend, the water stop plug 9 blocks the water outlet 4, and at the moment, the water flow is cut off by the switch valve, and the swimming pool stops draining.

In the second embodiment, the support element 2 is assembled on the water valve main body 1, one end of the support framework 5 is arranged on the side wall of the water valve main body 1, the other end of the support framework 5 is connected with the support head 6, and the water outlet 4 is provided with a 1-inch pipe orifice 13 and a 2-inch pipe orifice 13. The knob 7 penetrates through the threaded rod 8 and is fixed with the water stop plug 9 to form the switch valve for use, the knob 7 is fixed through the knob cover 10, the water stop plug 9 is aligned with the water outlet 4, the knob 7 is rotated, the knob 7 drives the water stop plug 9 to ascend or descend, the water stop plug 9 plugs or opens the water outlet 4 so as to open and close the switch valve.

The use and working method of the second embodiment lies in that: the water inlet 3 is sleeved on the water intake of the swimming pool, the water inlet 3 and the water intake of the swimming pool are fixed together through the spring clamp, the support head 6 is abutted against the side wall of the swimming pool, and the water outlet 4 is connected with the water pipe with the pipe diameter of 2 inches. When the swimming pool needs to be filled with water, the knob 7 is rotated counterclockwise, the knob 7 drives the water stop plug 9 to rise, the water stop plug 9 does not block the water outlet 4 anymore, and at the moment, the water flow direction flows into the swimming pool from the water pipe, flows through the water outlet 4, passes through the switch valve, flows into the water intake of the swimming pool from the water inlet 3, and flows into the swimming pool from the water intake. When the swimming pool does not need to be filled with water, the knob 7 is rotated clockwise, the knob 7 drives the water stop plug 9 to descend, the water stop plug 9 blocks the water outlet 4, and at the moment, the water flow is cut off by the switch valve, and the swimming pool stops filling.

In the third embodiment, the same swimming pool water valve is used to connect the drainage outlet of the swimming pool and the water intake of the swimming pool respectively, the water outlets 4 of two swimming pool water valves are connected together through a filter, the water from the drainage outlet of the swimming pool passes through the water valve of the swimming pool, flows through the filter, and after being filtered and purified is poured from another pool water valve into the water outlet of the swimming pool and back into the swimming pool. In this way, two identical swimming pool water valves can be directly purchased without purchasing special valves for swimming pool drainage and swimming pool filling, thereby saving the labour and time and the cost.

The advantageous effects of the present invention lie in that:

The present invention is provided with a water valve main body 1 and a support element 2. The support element 2 and the water valve main body 1 can be integrally formed, the support element 2 also can be assembled on the water valve main body 1, the support element 2 can support the water valve main body 1, embodied as: the side wall of the swimming pool is provided with a drainage outlet or a water intake, the water inlet 3 of the water valve main body 1 is aligned with the drainage outlet or the water intake of the side wall of the swimming pool, and the water inlet 3 is connected with the drainage outlet or the water intake. The support element 2 naturally rests against the side wall of the swimming pool. The water valve main body 1 and the water pipe generate a downward gravity due to gravity, and the downward gravity is transmitted to the support element 2, so that the support element 2 generates a thrust against the side wall of the swimming pool. According to Newton's third law, the side wall of the swimming pool will generate a reaction force of the same magnitude and opposite direction as the thrust, which cancels out the thrust. The support element 2 and the side wall of the swimming pool support the water valve main body 1. The water valve main body 1 and the water pipe cannot droop under the action of gravity. The water inlet 3 can be attached to the drainage outlet and the water intake of the swimming pool, so that overflow cannot occur, the drainage outlet and the water intake of the side wall of the swimming pool is prevented from being torn and damaged, and the swimming pool is good in durability and using effect.

Moreover, the water valve main body 1 comprises a water inlet 3, a water outlet 4 and a switch valve, and the side wall of the swimming pool is provided with a drainage outlet or a water intake. Therefore, the present invention can be assembled on the drainage outlet, at this time, the water flow direction flows from the drainage outlet through the water inlet 3, passes through the switch valve, and is discharged from the water outlet 4; and can be assembled on the water intake, at this time, the water flow direction flows from the water outlet 4, passes through the switch valve and flows from the water intake through the water inlet 3 into the swimming pool. The inflow and outflow of the pool water can be realized through the same water valve, and the water inlet valve and the drainage valve do not need to be purchased additionally. The switch valve controls the connection and the separation of the water inlet 3 and the water outlet 4, thereby controlling the opening and the closing of the inflow water flow and the outflow water flow of the pool water.

Therefore, the present invention provides a swimming pool water valve with a support element, which can realize the function of protecting the drainage outlet and the water intake of the swimming pool from being torn and damaged easily and avoiding water leakage, thereby achieving the effect of long-term stable and safe use of the product.

The above described embodiments are only the preferred embodiments of the present invention. It should be noted that, the present invention is not limited to the above preferred embodiments, and the protection scope of the present invention is defined by the claims. For a person skilled in the art, on the premise of not departing away from the spirit and scope of the present invention, several improvements and modifications may also be made, and such improvements and modifications are also deemed to be within the protection scope of the present invention.

The invention claimed is:

1. Swimming pool water valve with a support element, comprising:

a water valve main body, which comprises a water inlet connected with the swimming pool, a water outlet and a switch valve controlling the connection and the separation of the water inlet and the water outlet, and a support element arranged on the water valve main body, which supports the water valve main body wherein:

the support element comprises a support framework and a support head, the support framework connects with the water valve main body and the support head, which rests against the side wall of the swimming pool.

2. The swimming pool water valve with a support element according to claim 1, wherein, a spring clamp is arranged at the water inlet, the water inlet is fixed on a drainage outlet of the swimming pool by means of the spring clamp.

3. The swimming pool water valve with a support element according to claim 1, wherein, the switch valve comprises a knob, a threaded rod and a water stop plug, the knob rotates on the threaded rod, and the knob drives the water stop plug to close or open the water outlet.

4. The swimming pool water valve with a support element according to claim 2, wherein, the switch valve further comprises a knob cover, the knob is fixed on the water valve main body by means of the knob cover.

5. The swimming pool water valve with a support element according to claim 2, wherein, an O-shaped sealing ring is arranged on the water stop plug and the knob respectively.

6. The swimming pool water valve with a support element according to claim 2, wherein, a silica gel pad is arranged on the contact surface of the knob cover to the water valve main body.

7. The swimming pool water valve with a support element according to claim 1, wherein, a plurality of pipe orifices with different calibers are arranged on the water outlet, the pipe orifices are configured for connecting water pipes with different diameters.

8. The swimming pool water valve with a support element according to claim 1, wherein, the support element and the water valve main body are integrally formed.

9. The swimming pool water valve with a support element according to claim 1, wherein, the support element is configured to a separate element relative to the water valve main body and is mounted on the water valve main body.

10. The swimming pool water valve with a support element according to claim 1, wherein, a spring clamp is arranged at the water inlet, the water inlet is fixed on a water intake of the swimming pool by means of the spring clamp.

* * * * *